US005718171A

United States Patent [19]

Tittgemeyer et al.

[11] Patent Number: 5,718,171

[45] Date of Patent: Feb. 17, 1998

[54] PROCESS AND ROTARY PRINTING MACHINE FOR INDIRECT ROTOGRAVURE PRINTING

[75] Inventors: Udo Tittgemeyer, Arnsberg; Ingo Köbler, Anhausen, both of Germany

[73] Assignee: MAN Roland Druckmaschinen AG, Offenbach am Main, Germany

[21] Appl. No.: 599,855

[22] Filed: Feb. 13, 1996

Related U.S. Application Data

[63] Continuation of Ser. No. 374,030, Jan. 18, 1995, abandoned.

[30] Foreign Application Priority Data

Jan. 18, 1994 [DE] Germany ..... 44 01 362.0

[51] Int. Cl.[6] ..... B41F 9/01

[52] U.S. Cl. ..... 101/154; 101/170

[58] Field of Search ..... 101/170, 153, 101/154, 155, 366, 157, 169, 152

[56] References Cited

U.S. PATENT DOCUMENTS

| | | | |
|---|---|---|---|
| 1,428,080 | 9/1922 | Cooper | 101/154 |
| 1,702,769 | 2/1929 | Gail | 101/154 |
| 2,177,656 | 10/1939 | Kaddeland | 101/157 |
| 2,988,989 | 6/1961 | Crawford . | |
| 3,889,596 | 6/1975 | Thomas et al. | 101/154 |
| 4,004,939 | 1/1977 | O'Brien et al. | 106/135 |
| 4,474,110 | 10/1984 | Rosner | 101/154 |
| 4,506,059 | 3/1985 | Hultzsch et al. | 525/134 |
| 4,823,693 | 4/1989 | K+e,uml +ee bler | 101/218 |
| 4,903,599 | 2/1990 | Kübler et al. . | |
| 4,958,563 | 9/1990 | Lewis et al. | 101/458 |
| 4,982,660 | 1/1991 | Hamm et al. | 101/350 |
| 5,316,798 | 5/1994 | Tittgemeyer | 427/409 |

FOREIGN PATENT DOCUMENTS

| | | |
|---|---|---|
| 0 294 022 A1 | 12/1988 | European Pat. Off. . |
| 0 565 416 A1 | 10/1993 | European Pat. Off. . |
| 1410832 | 8/1965 | France . |
| 1531614 | 7/1968 | France . |
| 296512 | 2/1917 | Germany . |
| 3843017 | 5/1990 | Germany . |
| 3908999 | 9/1990 | Germany . |

OTHER PUBLICATIONS

"Ink–Report, Zusammensetzung, Herstellung und Anwendung von Druckfarben", Druckfarbenfabrik Gebr. Schmidt GmbH (1993), p. 39.

*Primary Examiner*—J. Reed Fisher

*Attorney, Agent, or Firm*—Cohen, Pontani, Lieberman & Pavane

[57] ABSTRACT

A process and rotary printing machine for indirect rotogravure printing without intermediate drying, wherein the printing ink with a viscosity in the range of 80 to 1000 mPa s is supplied to the rotogravure form cylinder by a chamber doctor. Additionally, the transfer cylinder carries a covering with a closed surface, low surface roughness, low wettability and high radial compressibility.

10 Claims, 3 Drawing Sheets

PROCESS AND ROTARY PRINTING MACHINE FOR INDIRECT ROTOGRAVURE PRINTING

This is a continuation of application Ser. No. 08/374,030, filed Jan. 18, 1995 now abandoned.

BACKGROUND OF THE INVENTION

1. Field of the Invention

The invention is directed to a process and to a rotary printing machine for indirect rotogravure printing.

2. Description of the Prior Art

As is shown in FIG. 1, the printing mechanism for traditional rotogravure contains a rotogravure form cylinder 1, an intermediate roller 3 and an impression cylinder 4. The web 5 is printed on one side as it passes between the rotogravure form cylinder and the intermediate roller. In order to achieve acceptable printing, the web must have high gloss conditional upon contact with the hard printing form. Further, it is disadvantageous that thin, solvent-containing printing inks are used which are needed so that the cells or pits of the printing form can be reliably filled and emptied when printing. Additionally, the solvent fumes burden the environment. Moreover, due to the thin solvent ink, intermediate drying is required between printing inks when printing with more than one color, since the color dots would otherwise run together on the printing stock. Apart from the cost in energy, the constant alternation between applying wet ink and drying puts a great strain on the web and substantial effort is required to maintain the register. Inking is carried out by dipping the rotogravure form cylinder into the ink and then wiping it with a doctor blade. Apart from ink spray and ink mist, this inking results in ink stagnating under the doctor blade which in turn leads to bending or deformation of the doctor blade. This can be compensated for by increasing the adjustment or screw-down forces of the doctor blade, but this results in increased wear on the printing form. Moreover, the deformation of the doctor blade is dependent upon circumferential speed, which leads to fluctuations in color. Immersion inking has the additional disadvantage that sleeve-shaped printing forms cannot be used, since leakage of the printing ink behind the form sleeve would cause the latter to stick to the supporting cylinder. Furthermore, the changing of printing forms is costly, since the ink pan must first be lowered to permit a change.

The cylinder configuration described above has also been used to carry out indirect printing by providing the intermediate roller with a rubber coat and guiding the web between the intermediate roller and impression cylinder. Due to the varying format in rotogravure form cylinders, the circumference of the form cylinder differs from that of the rubber-coated intermediate roller so that the two cylinders do not rotate with synchronized take-off. The intermediate roller must therefore be washed after every revolution. There is also no driving connection between the cylinders so that non-slip rolling between the cylinders and a smear-free printing cannot be guaranteed. Moreover, the intermediate roller and impression cylinder are thrown off jointly in a straight line from the rotogravure form cylinder during impression throw-off.

The German application P 43 28 027 discloses a printing mechanism for newspaper printing by indirect rotogravure printing in which the rotogravure form cylinder, transfer cylinder and impression cylinder have the same diameter and the printing form is inked with a water-soluble ink by means of a chamber doctor.

SUMMARY OF THE INVENTION

The object of the present invention is to provide a process for indirect rotogravure printing which achieves high-quality printing with all conventional inking systems without the need for intermediate drying. Moreover, a rotary printing machine is provided for carrying out the process.

Pursuant to this object, and others which will become apparent hereafter, one aspect of the present invention resides in a process for indirect rotogravure printing using a rotogravure form cylinder, a transfer cylinder and an impression cylinder. A chamber doctor is adjusted toward the rotogravure form cylinder and inks the printing form with an ink having a viscosity in the range of 80 to 1000 mPa s. The ink is then extensively or substantially lifted out of the pits of the printing form by a covering of the transfer cylinder when the transfer cylinder makes rolling contact with the rotogravure form cylinder. The ink is then transferred by re-adhesion to the printing stock as the printing stock passes between the transfer cylinder and the impression cylinder.

Another aspect of the invention resides in a rotary printing machine for indirect rotogravure printing, which printing machine includes a rotogravure form cylinder which can be covered by a printing form, a chamber doctor that is adjusted against the rotogravure form cylinder, and a transfer cylinder having a resilient surface and being arranged adjacent to the form cylinder. The transfer cylinder accepts the print image from the rotogravure form cylinder. The rotogravure form cylinder and the transfer cylinder have equal circumferences and are both mounted on journals. The printing machine further includes an impression cylinder as well as spur gears provided on the journals of the form cylinder and the transfer cylinder whereby the form cylinder and the transfer cylinder are in drive connection. Eccentric bushes are arranged on the journals of the transfer cylinder so that the transfer cylinder can be adjusted toward and away from adjacent cylinders. A coverting is provided on the transfer cylinder, which covering has a closed surface with a low surface roughness, low wettability and high compressibility.

With the indicated viscosity, the invention avoids stickiness, also called tack, so that the pits of the rotogravure form can be reliably filled. Moreover, the covering of the transfer cylinder with its smooth surface is able to effectively lift the ink out of the pits of the printing form so as to empty the pits to a great extent. Further, the closed surface of the covering prevents penetration and thus the separation of ink thinners so that there is no surface swelling. In contrast, the known rubber blankets or elastomer coverings from offset printing have a basically amorphous structure and, when used in combination with pasty, oily printing inks, cause an adhesion of the ink film which is greater than the adhesion to the printing form which results in subsequent splitting of the ink film when transferred to the printing stock. On the other hand, in the solution according to the invention the adhering printing ink is extensively or substantially transferred from the transfer substrate to the printing stock at the location of the film split. Complete transfer of the image located on the transfer substrate as ink film depends on the wettability, surface roughness and emulsion or coating cross-linkage of the outer covering in relation to the surface tension of the printing ink.

In addition to these surface characteristics, the covering of the transfer cylinder also satisfies substantial mechanical requirements. The recessed print dots (pits) of the rotogravure printing form are imaged on the covering and demand an extremely high degree of axial elasticity in the line of impression or the printing line. In contrast to the cylinder surface, the resilient, radially compressible covering has no resistance to the pits, which results in considerable transverse strain in the line of impression.

Moreover, in contrast to offset printing, the 1-to-1 wind-off ratio means that the tensioned printing line is permanently shifted with respect to rotation without the possibility of a release of tension. To cope with this situation, the extremely radially compressible covering has very high restoring forces (rebound resilience). The slightest damping (displacement) would lead to considerable tangential forces which could not be absorbed by the connection joint between the covering and the body of the transfer cylinder.

All conventional inking systems such as water-soluble, radiation-curable and offset inks, as well as environmentally sound inks, can be used with the invention. Due to the higher viscosity of the inks which can be used with the invention compared with conventional solvent printing inks, there is no need for disadvantageous intermediate drying when printing with multiple inks between the individual printing mechanisms. The drive connection between the form cylinder, transfer cylinder and impression cylinder is a prerequisite for non-slip rolling of these cylinders and accordingly for a clean, non-smear printing. Finally, indirect printing in combination with eccentric impression throw-off allows a simple, compact machine configuration analogous to offset printing, e.g., I-printing mechanisms, H-printing mechanisms, U-printing mechanisms, etc., which makes it possible to print on both sides of the printing stock. Due to the resilient covering, it is also possible to print on print substrates with rough surfaces, e.g., for newspapers and packaging.

In other embodiments of the inventive process, any one of a water-solvent ink, a radiation-curable ink and an offset printing ink are supplied to the rotogravure form cylinder from the chamber doctor.

In another embodiment of the inventive rotary printing machine, the covering of the transfer cylinder is made of a fully cross-linked aliphatic polyurethane or silicone.

In still another embodiment, the covering of the transfer cylinder has a surface with a surface roughness $R_z \leqq 6$ μm.

In still a further embodiment, the covering of the transfer cylinder has a radial rebound resiliency greater than 95%.

In yet another embodiment of the invention, the covering of the transfer cylinder is fastened to a substrate sleeve which is mounted on the cylindrical body of the transfer cylinder and can be pushed out of the printing machine axially from the cylindrical body through an opening in the sidewall of the printing machine. It is also possible to construct the printing form as a sleeve which is mounted on the cylindrical body of the rotogravure form cylinder so that the printing form can be pushed out of the printing machine axially from the cylindrical body through an opening in the sidewall of the printing machine.

In yet a further embodiment, the transfer cylinder of another printing machine functions as an impression cylinder. A further rotogravure form cylinder with a chamber doctor also being arranged at the transfer cylinder of the another printing mechanism.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
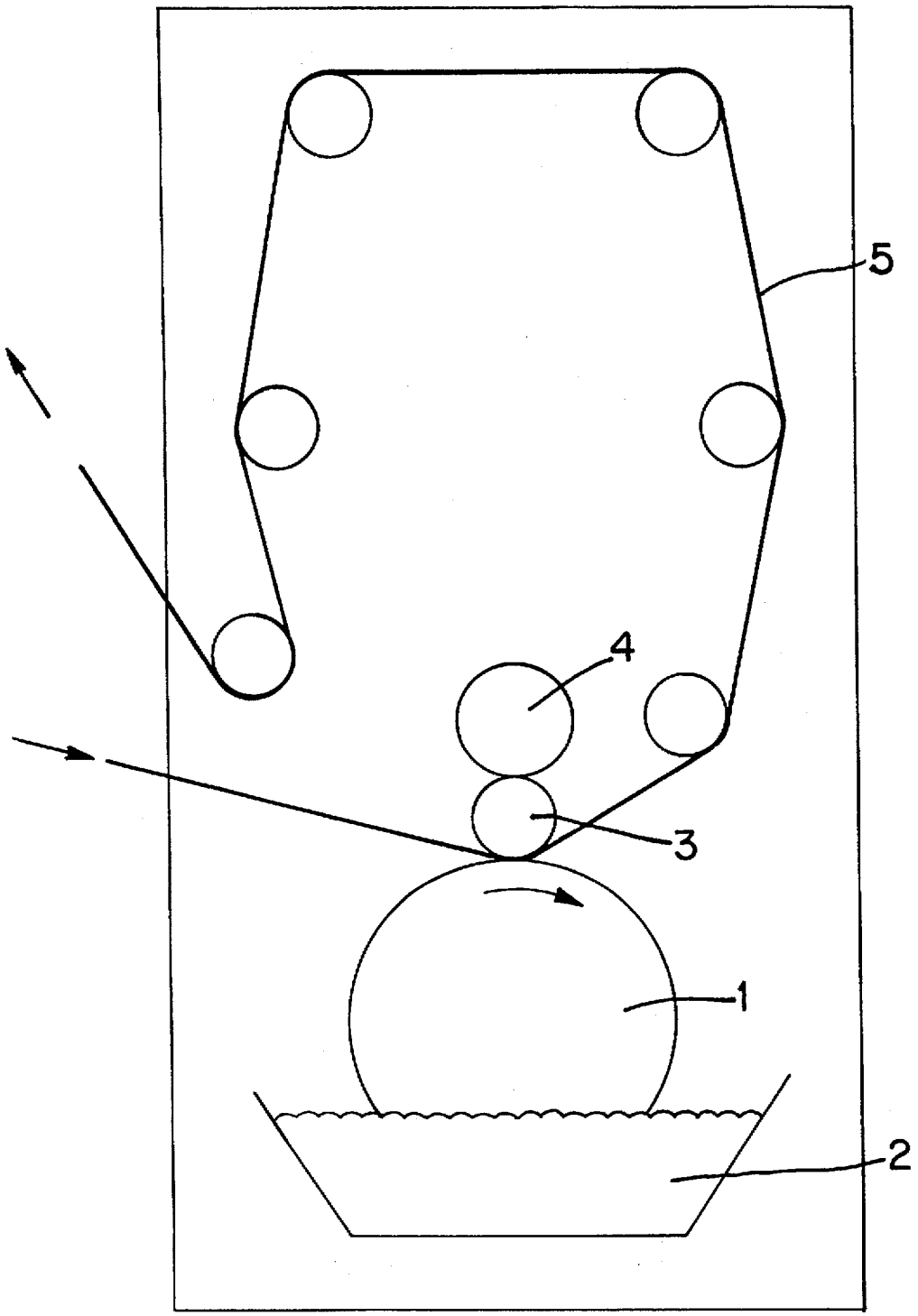
Prior Art FIG.1
FIG. 1 shows a rotogravure printing mechanism according to the prior art.
Figure 2:
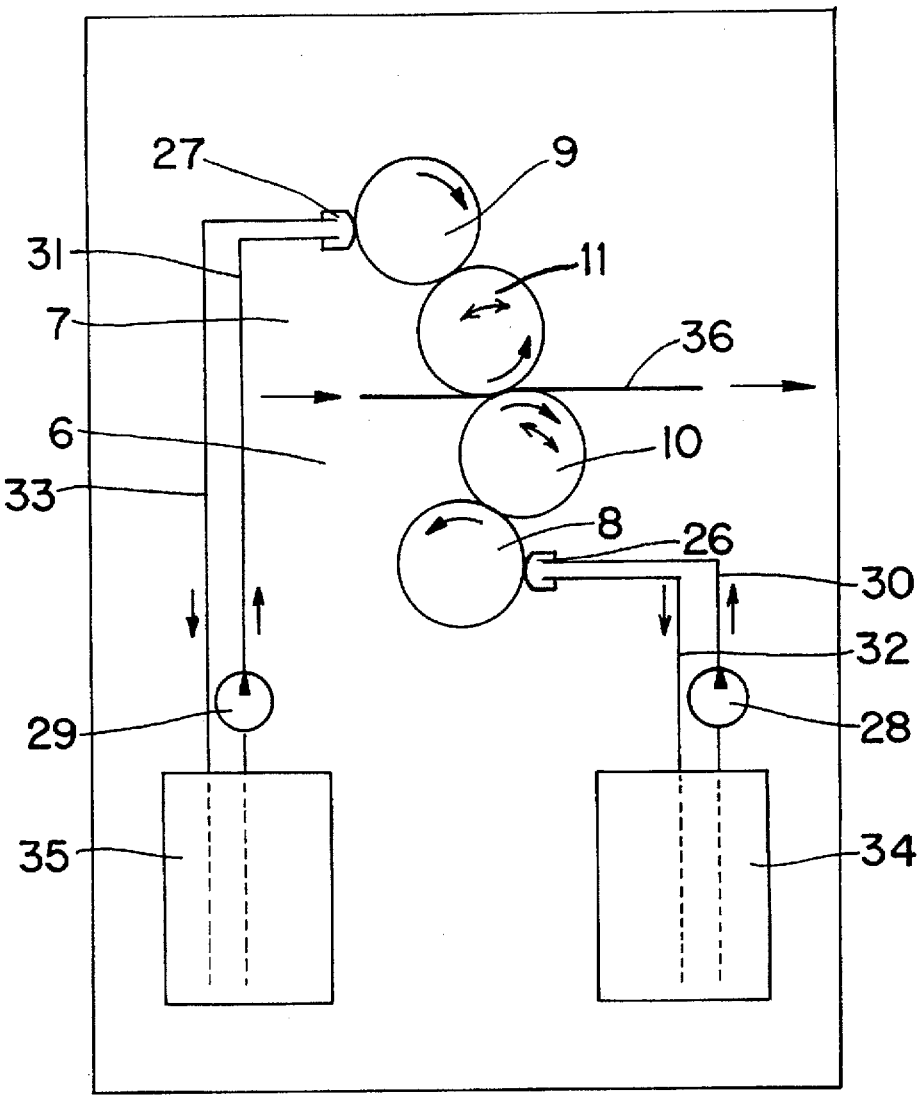
FIG. 2 shows a rotogravure printing unit with two printing mechanisms working pursuant to the rubber-on-robber principle.
Figure 3:
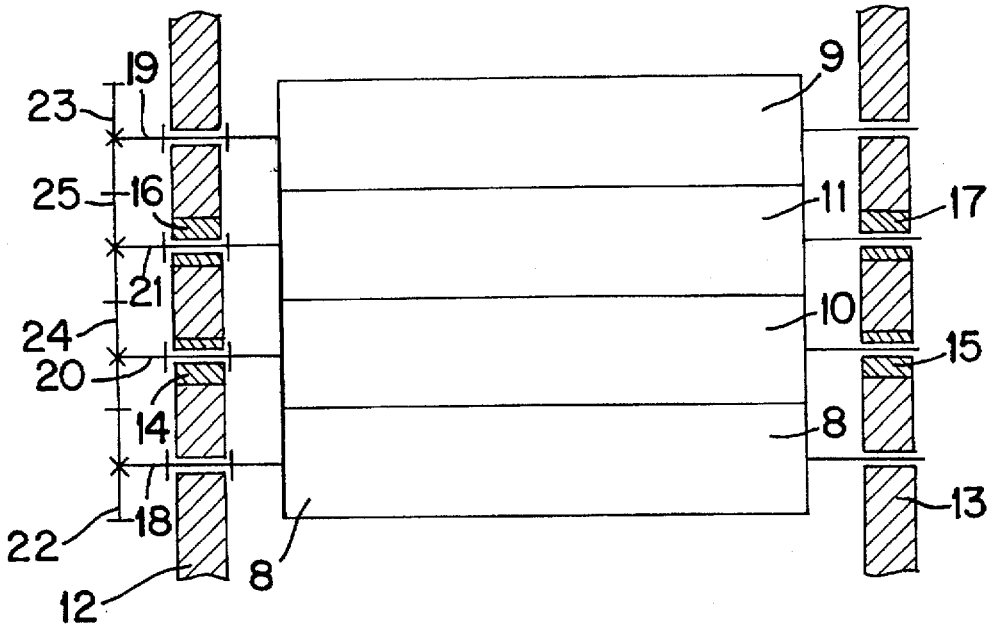
FIG. 3 shows the printing unit according to FIG. 2 in section.

The traditional rotogravure printing mechanism shown in FIG. 1 contains a rotogravure form cylinder 1, which is dipped into printing ink in an ink pan 2, an intermediate roller 3, and an impression cylinder 4. The web 5 is printed on one side as it passes between the rotogravure form cylinder 1 and the intermediate roller 3. In contrast, the rotogravure printing unit shown in FIG. 2 has two printing mechanisms 6, 7, each having a rotogravure form cylinder 8, 9 and a transfer cylinder 10, 11. All cylinders 8–11 are supported in side walls 12, 13 of the printing unit, with the transfer cylinders 10, 11 being received in eccentric bushes 14–17 (FIG. 3). The transfer cylinders 10, 11 are adjustable relative to the rotogravure form cylinder 8, 9 of the respective printing mechanism 6, 7 as well as relative to one another by means of the eccentric bushes 14–17. Each journal or neck 18–21 on the drive side of the cylinders 8–11 supports a spur gear 22–25 and, by means of this, is in a drive connection with the cylinder adjacent to it.

A chamber doctor 26, 27, which is supplied with ink by a pump 28, 29 via a feed line 30, 31, is adjustably arranged at each rotogravure form cylinder 8, 9. Return lines 32, 33 lead from the chamber doctors 26, 27 to ink containers 34, 35.

The rotogravure printing forms located on the rotogravure form cylinders 8, 9 are inked by the chamber doctors 26, 27. A water-based ink with a viscosity of approximately 80 to 120 mPa s is used in the described embodiment. However, other inks such as radiation-curable or offset printing inks with a viscosity of at least 80 to a maximum of 1000 mPa s can also be used. The chamber doctors 26, 27 are advantageously operated with circulating ink, i.e., the pumps 28, 29 deliver more ink than is required for printing. The surplus ink is returned to the ink containers 34, 35 via the return lines 32, 33. When the rotogravure form cylinder 8, 9 rolls off the respective transfer cylinder 10, 11, the inked pits transfer the printing ink to the transfer cylinder. In turn, the transfer cylinders 10, 11, in reciprocal rolling contact, transfer the print image to the web 36 guided between them.

Figure 4:
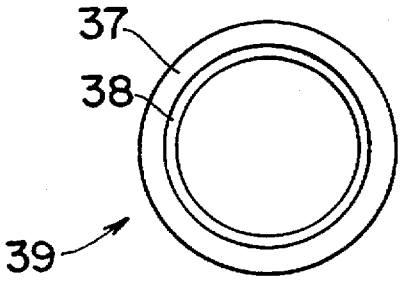
FIG. 4 shows a side view of the cover sleeve of the transfer cylinder.

Each transfer cylinder 10, 11 carries a covering of fully cross-linked aliphatic polyurethane. Silicone could also be used. The covering 37 is advantageously applied to a metallic substrate sleeve 38. This coveting sleeve 39 is shown in FIG. 4. The covering 37 has a surface roughness $R_z \leqq 6$ μm. The radial rebound resilience of the covering is greater than 95% and its permanent set is less than 5%, preferably less than 0.30 to 0.65 g/cm$^3$. Such transfer cylinder sleeves are described in DE 39 08 999 C2.

Figure 5:
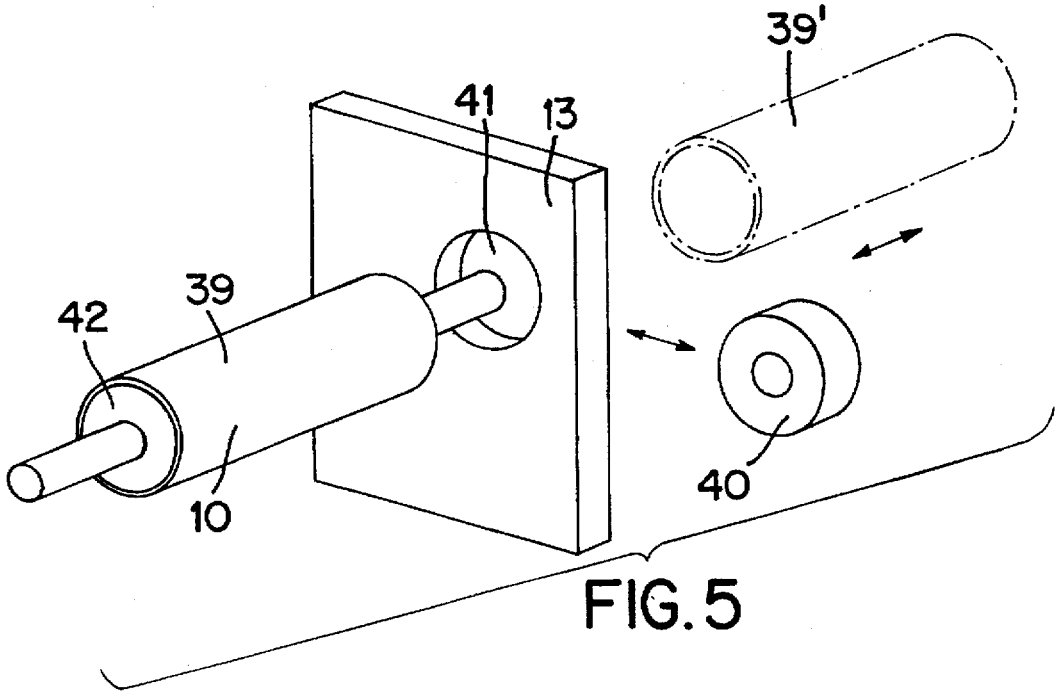
FIG. 5 shows the changing of the cover sleeve of the transfer cylinder.

FIG. 5 shows the changing of the cover sleeve 39 for the transfer cylinder 10, for which purpose a wall piece 40 is removed from the side wall 13 of the printing machine creating an opening 41 through which the cover sleeve 39 is pushed out of the printing mechanism axially from the cylindrical body 42 of the transfer cylinder 10. The diameter of the opening 41 is greater than the outer diameter of the cover sleeve 39. The rotogravure forms of the rotogravure form cylinders 8, 9 are advantageously also designed as sleeves which can likewise be changed using the principle shown in FIG. 5. However, by using the invention, the cover sleeves or form sleeves can also be changed when the corresponding cylinders have been removed from the printing mechanism. For this purpose, slots are created in the side walls by removing filling pieces. The rotogravure form cylinder can also be provided, for example, with individual printing forms which are arranged in an abutting relationship and adhere magnetically. The rotogravure form can also be applied to the cylindrical body of the rotogravure form cylinder in a permanent fashion. For this purpose, the cylinder can be provided with images and erased within the printing machine.

The invention is not limited by the embodiments described above which are presented as examples only but can be modified in various ways within the scope of protection defined by the appended patent claim.

We claim:

1. A process for indirect rotogravure printing, consisting essentially of the steps of: providing a rotogravure form cylinder; placing a transfer cylinder against an impression cylinder; adjusting a chambered doctor blade toward the rotogravure form cylinder and inking a printing form on the form cylinder using the chambered doctor blade with an ink having a viscosity in a range of 80 to 1000 mPa s; lifting the ink out of pits in the printing form using a covering of the transfer cylinder, which cover has a closed surface, a surface roughness $R_z \leqq 6$ μm and low wettability, by placing the transfer cylinder in rolling contact with the rotogravure form cylinder; and transferring all the ink by re-adhesion to printing stock as the printing stock passes between the transfer cylinder and the impression cylinder, due to the closed surface, surface roughness and low wettability of the covering.

2. A process according to claim 1, including supplying a water-solvent ink to the rotogravure form cylinder using the chambered doctor blade.

3. A process according to claim 1, including supplying a radiation-curable ink to the rotogravure form cylinder using the chambered doctor blade.

4. A process according to claim 1, including supplying an offset printing ink to the rotogravure form cylinder using the chambered doctor blade.

5. A rotary printing machine for indirect rotogravure printing, comprising: a rotogravure form cylinder; a printing form with a print image arranged and adapted to cover the form cylinder; a chambered doctor blade arranged and adapted to be adjustable against the rotogravure form cylinder to ink the printing form with an ink having a viscosity in a range of 80 to 1000 mPa s a transfer cylinder having a resilient surface, the transfer cylinder being arranged adjacent to the form cylinder and adapted to accept the print image from the rotogravure form cylinder, the rotogravure form cylinder and the transfer cylinder having journals and an equal circumference; an impression cylinder adjacent the transfer cylinder; spur gears provided on the journals of the form cylinder and the transfer cylinder whereby the form cylinder and transfer cylinder are in drive connection; eccentric bushes arranged on the journals of the transfer cylinder whereby the transfer cylinder can be adjusted toward and away from the adjacent cylinders; sidewalls which the journals of the cylinders are supported; a covering provided on the transfer cylinder, the covering having a closed surface, a surface roughness $R_z \leqq 6$ μm, low wettability and a radial rebound resiliency greater than 95%; and means for feeding ink to the chambered doctor blade, the ink feeding means including an ink reservoir, an ink pump connected between the ink reservoir and the chambered doctor blade, and an ink return connected between the chambered doctor blade and the ink reservoir.

6. A rotary printing machine according to claim 5, wherein the covering of the transfer cylinder is made of a fully cross-linked aliphatic polyurethane.

7. A rotary printing machine according to claim 5, wherein the covering of the transfer cylinder is made of silicone.

8. A rotary printing machine according to claim 5, wherein the transfer cylinder has a cylindrical body, one of the sidewalls having an opening therein, and further comprising a substrate sleeve removably mounted on the cylindrical body of the transfer cylinder whereby the sleeve can be pushed out of the printing machine axially from the cylindrical body through the opening in the sidewall, the covering of the transfer cylinder being fastened to the substrate sleeve.

9. A rotary printing machine according to claim 5, wherein one of the sidewalls has an opening therein, the rotogravure form cylinder having a cylindrical body and the printing form being a sleeve removably mounted on the cylindrical body of the rotogravure form cylinder whereby the printing form can be pushed out of the printing machine axially from the cylindrical body through the opening in the sidewall.

10. A rotary printing machine according to claim 5, wherein the impression cylinder is a further transfer cylinder of another printing mechanism, and further comprising a further rotogravure form cylinder with a further chambered doctor blade arranged at the further transfer cylinder.

* * * * *